United States Patent [19]

Lambert

[11] Patent Number: 4,819,886

[45] Date of Patent: Apr. 11, 1989

[54] ROTARY HAMMER MILL FOR BREAKING STONE AND SIMILAR MATERIAL

[76] Inventor: Gene F. Lambert, 2023 Cochran Rd., Maryville, Tenn. 37801

[21] Appl. No.: 142,482

[22] Filed: Jan. 6, 1988

[51] Int. Cl.[4] ..... B02C 13/282

[52] U.S. Cl. ..... 241/186.1; 241/189 A; 241/275

[58] Field of Search ..... 241/189 A, 189 R, 88.4, 241/88.1, 186.1, 194, 195, 275

[56] References Cited

U.S. PATENT DOCUMENTS 4,697,743 10/1987 Bjorck et al. ..... 241/188 R X

*Primary Examiner*—Mark Rosenbaum

*Attorney, Agent, or Firm*—Luedeka, Hodges & Neely

[57] ABSTRACT

A rotary hammer mill for breaking stone, gravel and similar material to achieve a desired size reduction. The mill includes a plurality of hammerheads rotatably supported in a housing for rotation in a substantially horizontal plane to define a substantially horizontally disposed annular breaking zone. The hammerheads are rotatably driven at a breaking speed sufficient to cause the hammerheads to reduce material impacting against the hammerheads in the breaking zone. Material is introduced down into the breaking zone in an annular pattern so that the feed of material into the breaking zone is annularly distributed rather than concentrated at a single feed location. As a result, the proportion of the total material feed which is broken up initially upon entering the annular breaking zone is increased as compared to that of a hammer mill having a single feed location to promote uniform, rapid reduction of the material and thereby reduce the production of fines or excessively reduced material caused by retention of material in the mill.

14 Claims, 3 Drawing Sheets

ROTARY HAMMER MILL FOR BREAKING STONE AND SIMILAR MATERIAL

The present application relates to rotary hammer mills for breaking stone, gravel and similar material.

Known rotary hammer mills for breaking stone typically employ a plurality of hammerheads revolving at a relatively high speed in a plane under the influence of a motor driven shaft. The hammerheads rotate in a housing into which the material is fed and from which the material is discharged after having been reduced to a desired size by impact with the revolving hammerheads, interparticle collisions, and collisions with stationary structure in the housing.

It is desirable in such machines that the material be rapidly reduced to a uniform size and that the production of fines or excessively reduced material be minimized. Rotary hammer mills of the prior art have not been particularly successful in achieving these ends. This is believed to be due in large part to retention of the material in the mills resulting in a large proportion of the material being ground up into fines. This is wasteful both in terms of wear and tear on the parts of the mill and in terms of product loss.

Accordingly, it is an object of the invention to provide a rotary hammer mill for breaking up stone, gravel and similar material in which the quantity of fines or excessively reduced material is decreased as compared to known rotary hammer mills.

Another object of the invention is the provision of a rotary hammer mill of the character described which is capable of rapidly reducing the material to a uniform size with a minimum of wear and tear on its working mechanisms.

A further object of the invention is to provide a rotary hammer mill of the character described which is simple in construction and which lends itself to convenient and inexpensive maintenance.

The above and other objects and advantages of the present invention will become further known and may best be understood by reference to the following detailed description when considered in conjunction with the accompanying drawings in which.

Before making specific reference to the drawings, the more general aspects of the invention will be described to facilitate a better understanding of the details to follow.

Basically, the invention includes a rotary hammer mill for breaking stone, gravel and similar material to reduce the material to a desired size or range of sizes. The mill comprises a housing and a plurality of hammerheads rotatably supported in the housing for rotation in a substantially horizontal plane to define by their path of movement a substantially horizontal annular breaking zone.

Structure is provided for rotatably driving the hammerheads at a breaking speed sufficient to reduce material impacting against the hammerheads in the breaking zone. Provision is made for discharging reduced material from the housing.

Material feed structure is provided for feeding material into the housing and is configured to introduce the material down into the breaking zone in an annular pattern so that the feed of material to the breaking zone is annularly distributed rather than concentrated at a single feed location. As a result, the proportion of the total material feed which is broken up initially upon entering the annular breaking zone is increased as compared to that of a hammer mill having a single feed location to promote uniform, rapid reduction of the material and thereby reduce the production of fines or excessively reduced material caused by retention of material in the mill.

Preferably, the material is introduced down into the breaking zone in an annular pattern through the provision of a plurality of circumferentially spaced apart feed openings located in the housing above the breaking zone.

In a preferred form of the invention, the mill also includes a plurality of elongate, generally radially extending upper breakers supported in the housing above the breaking zone and configured to break material flung against the breakers by the hammerheads. The feed openings extend down through the upper breakers so that stone is annularly distributed down into the breaking zone from between the upper breakers. In addition, the reduced material is discharged from the housing through a plurality of circumferentially spaced apart discharge openings. A plurality of elongate, generally radially extending lower breakers are supported in the housing below the breaking zone and are circumferentially spaced from adjacent lower breakers by the discharge openings so that reduced material is discharged from the housing between the lower breakers. Like the upper breakers, the lower breakers are configured to break stone flung against the breakers by the hammerheads.

Figure 1:
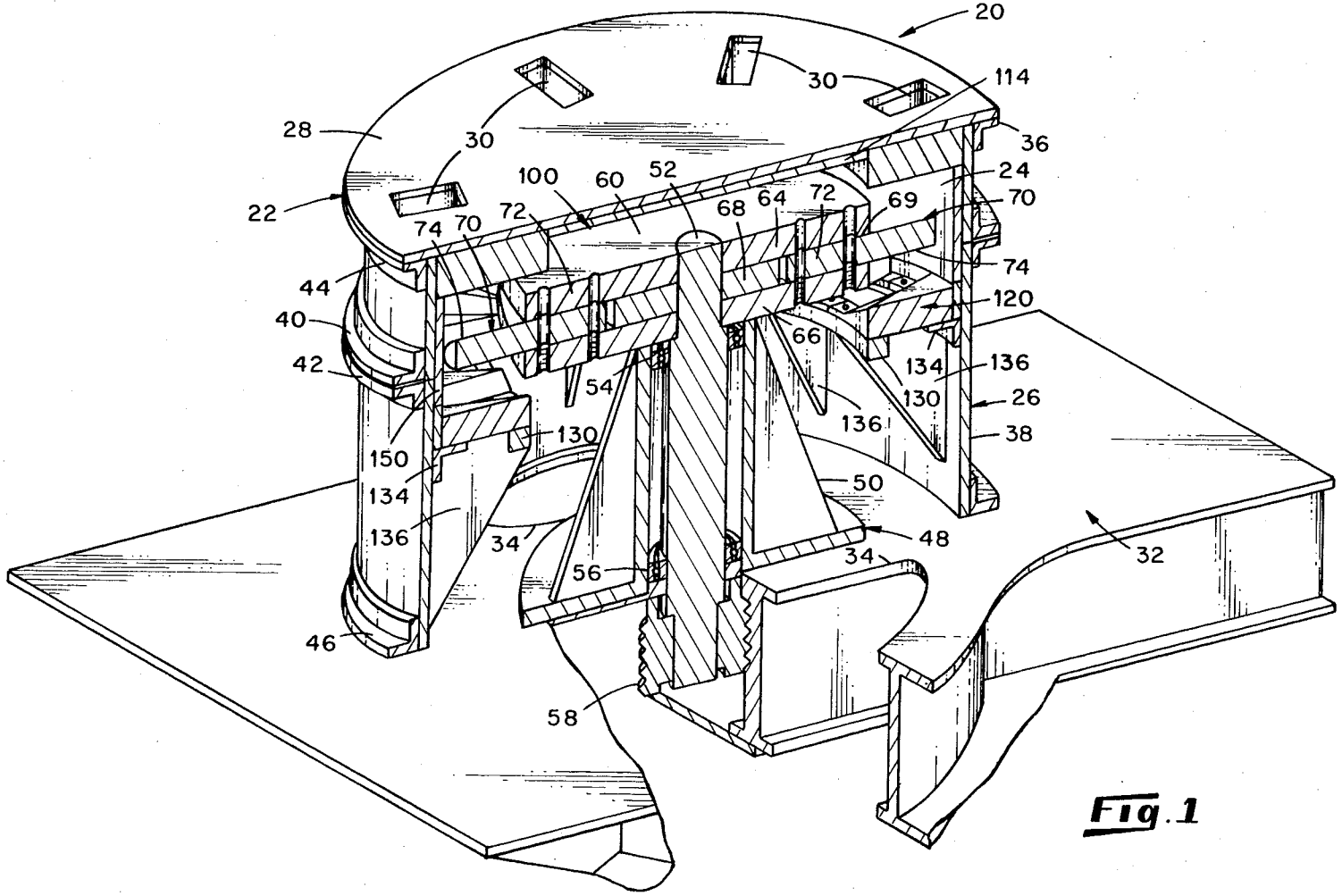
FIG. 1 is a fragmentary perspective view illustrating features of a rotary hammer mill constructed in accordance with a preferred embodiment of the present invention, with parts broken away to show details of the construction.
Figure 2:
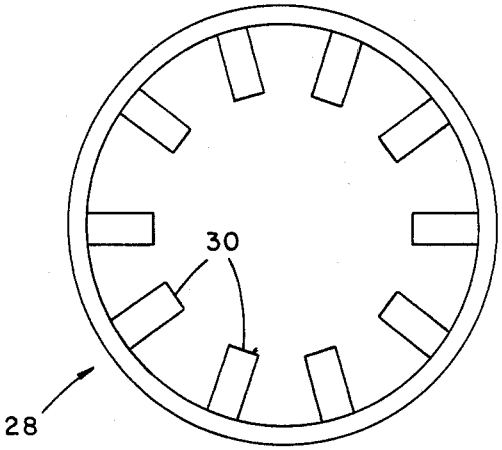
FIG. 2 is a top view of a cover for a housing in which material is broken illustrating a plurality of annularly disposed, spaced apart material feed openings in the cover.

Referring now to the drawings in which like reference characters designate like or similar parts throughout the several views, a rotary hammer mill 20 is shown in FIG. 1 illustrating features of a preferred embodiment of the invention. Various portions of the mill 20 shown in FIG. 1 are illustrated in individual FIGS. 2 through 9 and reference will be made to these figures from time to time to facilitate a better understanding of the overall construction and operation of the device. In addition, it is noted that the mill 20 shown in FIG. 1 is broken away along a vertical plane bisecting the device in order to illustrate internal parts. The half which is omitted is substantially identical to the half which is shown.

In the illustrated embodiment, the mill 20 includes a housing 22 which generally defines a working chamber 24 in which the material is broken up. The housing 22 includes an upright cylindrical wall-defining portion 26 and is enclosed at its top by a circular cover 28 supported on the cylindrical portion. As further described hereinafter, the cover 28 includes a plurality of circumferentially spaced apart openings 30 for feeding material into the housing. Although not shown, a suitable hopper/feed arrangement is provided for delivering material to the feed openings 30 in the cover 28.

The wall-defining portion 26 of the housing 22 is supported on a base 32 of suitable construction such as the illustrated I-beam flooring structure. The lower opening of the portion 26 encompasses a pair of diametrically opposed outlet openings 34 provided in the base 32 for passing reduced material out of the mill.

The wall-defining portion 26 of the housing 22 is preferably divided into upper and lower wall sections 36 and 38, respectively, along a horizontal plane approximately two-thirds of the way up the portion 26. These sections are secured together by external annular flanges 40 and 42 along with bolts (not shown) so that the upper section 36 can be removed from the lower section 38. The cover 28 is secured to the upper section 36 by an external annular flange 44 which is preferably welded to the outside of the upper section 36 and bolted to the cover 28 so that the cover 28 can be removed from the upper section 36. The lower section is secured to the base 32 using an external flange 46 which is preferably bolted to the base 32 and welded to the lower portion 38 of the portion 26. It is noted that the flanges 40, 42, 44 and 46 are L-shaped in cross-section to provide structural support for the housing 22 against deformation radially outwardly during operation of the hammer mill 20 in addition to providing a means by which the portions of the housing are secured together.

A rotor/hammerhead drive assembly 48 includes an upright truncated cone-shaped support 50 mounted on the base 32 between the openings 34. A vertically disposed drive shaft 52 is rotatably supported in the support 50 by upper and lower bearings 54 and 56. The lower end of the shaft 52 projects downwardly below the upper surface of the base 32 and carries a pulley 58. Drive belts (not shown) are trained over the pulley 58 in a conventional fashion and impart rotation to the shaft 52 under the influence of a suitable power source such as an electric motor, for example. Of course, other means of imparting rotation to the shaft 52 may be used. In a preferred embodiment, irrespective of the particular rotative power configuration employed, it is preferred that the assembly 48 be configured to rotate in both a clockwise and a counterclockwise direction for a purpose to be described.

Figure 5:
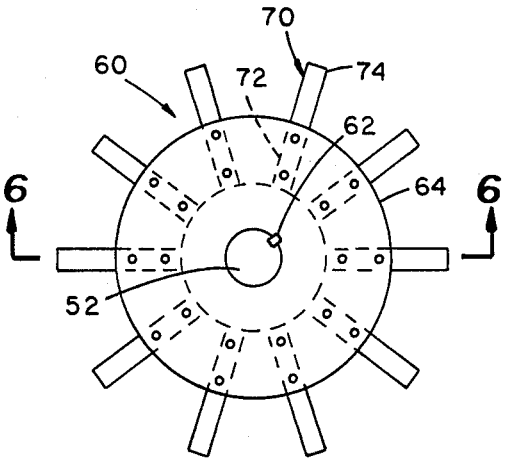
FIG. 5 is a top view of a rotor/hammerhead assembly which is rotatably mounted in the housing between the upper breaker plate and the lower breaker ring.

A rotor/hammerhead assembly 60 is carried on the upper end of the shaft 52 and is secured against rotation relative to the shaft as by a slot and key arrangement 62 shown in FIG. 5. The rotor portion of the assembly 60 includes an upper rotor half 64 and a lower rotor half 66, both of which are disk-shaped in configuration and substantially horizontally disposed. The halves 64 and 66 preferably have substantially identical dimensions. A disk-shaped spacer 68 divides the upper and lower rotor halves 64 and 66 and has an outer diameter less than that of the rotor halves 64 and 66 to provide an annular space 69 between the halves adjacent their outer edges.

The rotor/hammerhead assembly 60 also includes a plurality of radially extending substantially horizontally disposed hammerheads 70. Each hammerhead 70 includes an inner end 72 which is supported in the annular space 69 between the upper and lower rotor halves 64 and 66 and an outer end 74 extending radially outwardly from the rotor halves and terminating adjacent the inside of the portion 26 of the housing 22. Rotation of the shaft 52 causes the hammerheads 70 to be revolved in the working chamber 24 in a substantially horizontal plane to define a substantially horizontally disposed annular breaking zone in which material is broken up by impact with the hammerheads as will be described.

Figure 7:
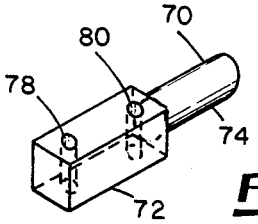
FIG. 7 is a perspective view of one of the hammerheads forming a portion of the rotor/hammerhead assembly shown in FIG. 5.
Figure 8:
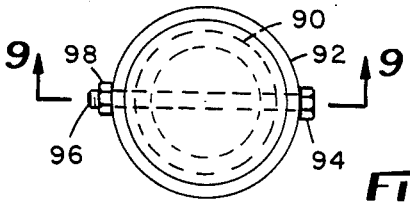
FIG. 8 is a top view illustrating a retainer ring for use in holding the hammerheads in the rotor/hammer assembly of FIG. 5.

As shown in FIG. 7, the hammerheads 70 are preferably rectangular in cross-section along their inner ends 72 which are received between the planar surfaces of the rotor halves 64 and 66 to restrict the hammerheads 70 against rotation along their axes. However, the outer ends 74 of the hammerheads 70 which project out from the rotor halves 64 and 66 are preferably elongate and circular in cross-section to define elongate convex impacting surfaces for a purpose to be described. Because of the severe impacts to which the hammerheads 70 are subjected, it is preferred that the hammerheads be solid in construction and that a metal be selected which is compatible with the conditions.

The inner end 72 of each hammerhead 70 is provided with a pair of openings 78 and 80. The openings 78 are spaced toward the innermost ends of the hammerheads 70 from the openings 80 and together with the openings 80 facilitate attachment of the hammerheads 70 between the rotor halves 64 and 66 as described below.

Figure 6:
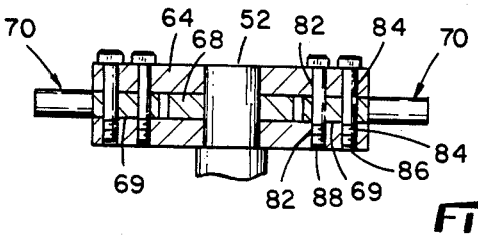
FIG. 6 is a view taken along line 6—6 of the rotor/-hammerhead assembly of FIG. 5.

Considering FIG. 7 together with FIGS. 5 and 6, it will be seen that the upper and lower rotor halves 64 and 66 each contain a plurality of pairs of circumferentially spaced apart radially aligned openings. Each pair contains a radially innermost opening 82 and a radially outermost opening 84. The pairs of openings in the upper rotor half 64 are axially aligned with the pairs of openings in the lower rotor half 66. Also, the openings 82 and 84 are spaced apart the same distance as the openings 78 and 80 in the hammerheads 70.

The hammerheads 70 are placed in the annular space 69 between the rotor halves 64 and 66 by positioning the rectangular inner ends 72 in the annular space 69 with the openings 78 and 80 of the hammerheads 70 aligned with the openings 82 and 84 in the rotor halves 64 and 66. Pivot pins 86 are then inserted into openings 84 in the upper rotor half 64, down through the openings 80 in the hammerheads 70, and into the openings 84 in the lower rotor half 66. Shear pins 88 are inserted into the openings 82 in the upper rotor half 64, down through the openings 78 in the hammerheads 70, and into the openings 82 in the lower rotor half 66. Since the openings 82 and 84 in each of the rotor halves 64 and 66 are radially aligned, the hammerheads 70 are substantially radially disposed outwardly of the rotor halves 64 and 66 and project into the working chamber 24 of the housing 22.

The shear pins 88 and the openings 82 and 78 through which they are received are preferably smaller in diameter than the pivot pins 86 and the openings 84 and 80 through which they are received. The diameter of the shear pins 88 and their material of construction is selected so that if for any reason a predetermined excessive resistance is opposed to the action of the hammerheads 70, the shear pins 88 will break off permitting the hammerheads 70 to rotate about the pivot pins 86 to a position at which they escape the effect of the excessive resistance, thereby preventing damage to the rotor/-hammerhead assembly 60 or drive assembly 48.

Figure 9:
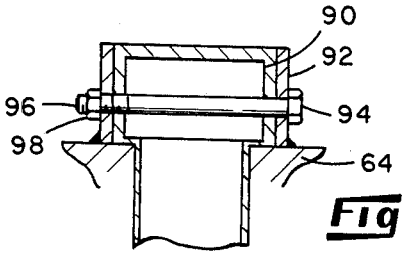
FIG. 9 is a view along line 9—9 of the retainer ring shown in FIG. 8.

The pins 86 and 88 are preferably maintained in position by providing each pin with an enlarged head 90 at its end adjacent the upper surface of the upper rotor half 64 as shown in FIG. 9. The heads 90 are positioned in retainer rings 92 which are welded or otherwise suitably secured to the top surface of the upper rotor half 64 and configured to encircle the top end of each of the openings 82 and 84. Bolts 94 are received through openings provided in the rings 92 and heads 90 to prevent axial displacement of the pins 86 and 88 and are secured in position through the provision of threaded ends 96 together with nuts 98.

Figure 3:
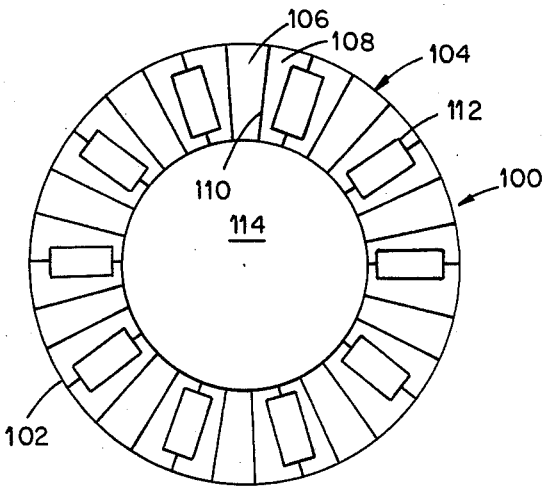
FIG. 3 is a bottom view of an upper breaker plate which is associated with the cover shown in FIG. 2.

Referring now to FIG. 1 together with FIG. 3, an upper breaker plate 100 is supported (as will be described) in the upper part of the housing 22 immediately below the cover 28 and above the plane of the hammerheads 70. The plate 100 is configured to define an annular band or ring 102 of radially disposed elongate upper breakers 104 facing down towards the working chamber 24 of the housing 22 above the path of rotation of the hammerheads 70. The breakers 104 are preferably solid in construction and formed of the same metal as the hammerheads 70.

Each upper breaker 104 preferably comprises a pair of substantially perpendicular planar breaker surfaces 106 and 108 disposed at an angle of about 45° with respect to horizontal. The surfaces meet to define an edge 110 extending along a radially disposed line and face down towards the working chamber 24. Preferably, the radially innermost ends of the edges 110 are approximately vertically aligned with the outer edge of the upper rotor half 64, and the edges 110 extend out to adjacent the portion 26 so that the ring 102 of breakers overlies substantially the entire breaking zone defined by the revolving hammerheads 70. In addition, the edges 110 lie in a substantially horizontal plane which is just above the plane of the top surface of the upper rotor half 64 and which has a minimum distance from the breaking zone defined by the hammerheads 70 of about, but greater than the desired size of the reduced material.

The breaker surfaces 106 face in the direction of rotation of the rotor/hammerhead assembly 60 and the breaker surfaces 108 face in a direction opposite to the direction of rotation of the assembly 60. Circumferentially spaced apart openings 112 are provided in the ring 102 at locations which are aligned with the locations of the openings 30 in the cover 28 so that material which is fed into the openings 30 passes into the working chamber 24 through the openings 112 in the plate 100. In the illustrated embodiment, the openings 112 alternately lie on the edge 110 of a breaker 104 and at the base between two adjacent breakers 104. The center portion of the plate 100 is preferably provided by a circular planar portion 114 which is disposed against the underside of the cover 28.

Figure 4:
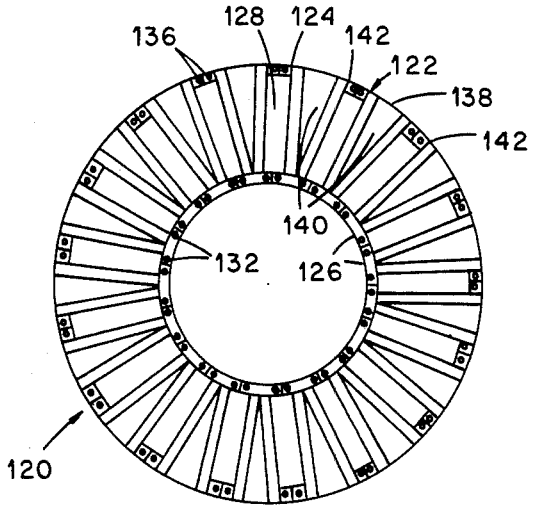
FIG. 4 is a top view of a lower breaker ring which is disposed in the housing in spaced apart relation below the upper breaker plate of FIG. 3.

A lower breaker ring generally designated at 120 is supported in the housing 22 below the plane of the hammerheads 70. As shown in FIG. 4, the ring 120 includes a plurality of circular ring sectors 122 which are arranged together to define the overall general configuration of the ring 120. Each sector 122 includes a pair of outer toes 124 and a pair of inner toes 126. The toes within each pair project from opposite circumferential sides of the sector.

The sectors 122 are arranged with the inner and outer toes 126 and 124 of adjacent sectors in abutment to define discharge openings 128 extending radially between the inner and outer toes of each pair of adjacent sectors 122. The width of the openings 128 is preferably slightly greater than the desired size of the reduced material.

The inner toes 126 are supported on an inner ring 130 as shown in FIG. 1 and may be secured to the ring 130 by bolts (not shown) received in openings 132 provided adjacent the ends of the toes 126. The outer toes 124 are supported on an outer ring 134, also shown in FIG. 1, and may be fastened to the ring 134 using bolts (not shown) received in openings 136 provided in the toes 124. The radial distance between the inner and outer rings 130 and 134 is preferably substantially equal to the radial dimension of the discharge openings 128. The rings 130 and 134 are supported in the housing 22 on a plurality of upright gussets mounted on the lower wall section 38 and configured to dispose the ring 120 at a proper elevation with respect to the hammerheads 70.

In a preferred embodiment, each of the circular ring sectors 122 defines a lower breaker 138 which projects up toward the working chamber 24 from below the path of rotation of the hammerheads 70. Preferably, the breakers 138 are triangular viewed from the top as shown in FIG. 4. The upper surface 140 of each breaker 138 is preferably planar and horizontal. The lower breakers 138 are preferably solid in construction and formed of the same metal as the upper breakers 104 and the hammerheads 70.

Preferably, the radially innermost ends of the surfaces 140 are approximately vertically aligned with the outer edge of the lower rotor half 66, and the surfaces 140 extend out to adjacent the portion 26 so that the ring of lower breakers 138 underlies substantially the entire breaking zone defined by the revolving hammerheads 70. In addition, the surfaces 140 are preferably disposed in a substantially horizontal plane which has a minimum distance from the breaking zone defined by the hammerheads 70 of about, but greater than, the desired size of the reduced material.

Each breaker 138 includes side surfaces 142 extending down from opposite sides of the upper surface 140. Preferably, the side surfaces 142 are disposed at an angle of about 45° with respect to horizontal and are configured so that one of the side surfaces faces in the direction of movement of the hammerheads 70 and the other side surface faces opposite to the direction of movement of the hammerheads.

A sleeve or spacer 150 is provided in the housing 22 adjacent the inside of the wall-defining portion 26 and preferably extends between the upper breaker plate 100 and the outer ring 134 on which the lower breaker ring 120 is supported, and functions to support the plate 100 in a predetermined spacing above the plane of the hammerheads 70. As shown, the lower breaker ring 120 preferably fits into the lower part of the spacer 150.

In operation, the rotor/hammerhead assembly 60 is rotated at a breaking speed under the influence of the motor driven shaft 52 so that the hammerheads 70 define the above-mentioned substantially horizontal annular breaking zone in the working chamber 24. Preferred speeds of the hammerheads 70 lie in the range of from about 7,000 ft./min. to about 12,000 ft/min. Material is gravity fed down into the breaking zone of the working chamber 24 through the feed openings 30 in the cover 28 and the aligned openings 112 in the plate 100. The arrangement of the openings 30 and 112 in a circumferentially spaced apart manner provides a preferred means by which the material is introduced down into the breaking zone in an annular pattern so that the material is annularly distributed rather than concentrated at a single feed location. In this regard, it is preferred that the feed be substantially uniformly distributed in a substantially continuous, uninterrupted ring which, in the illustrated embodiment, is accomplished by providing the openings 30 and 112 in a number corresponding to the number of hammerheads 70 which are used (10), and with all pairs of openings 30 and 112 having substantially the same dimensions and being substantially equally spaced from adjacent pairs. Moreover, it is preferred that each pair of openings 30 and 112 extend radially across substantially the entire width of the annular breaking zone defined by the revolving hammerheads 70 so that the feed, in addition to being annularly distributed, is also radially distributed across the width of the breaking zone.

Upon entering the breaking zone, pieces of the material are broken up initially upon impact with the revolving hammerheads 70. In addition, pieces are reduced by collisions with other pieces flying about in the chamber 24. Also, pieces are flung off the hammerheads 70 generally omnidirectionally because of the convex shape of the outer ends 74 causing the pieces to be reduced by impact against the upper and lower breakers 104 and 138 both above and below the breaking zone. And, since the upper and lower breakers 104 and 138 overlie and underlie substantially the entire annular breaking zone defined by the revolving hammerheads 70, material which is flung up or down from the hammerheads is likely to be directed against a breaker irrespective of the radial position along the length of the hammerheads from which the material is flung.

Pieces which have been sufficiently reduced pass through the discharge openings 128 in the lower breaker ring 120 and then on for further processing or accumulation through the outlet openings 34 in the base 32.

Among the advantages offered by the mill of the present invention is the reduction of fines or excessively reduced material produced in the breaking process. This is a result of the fact that the material is introduced down into the breaking zone of the hammerheads 70 in an annular pattern so that the overall flow of material into the working chamber is annularly distributed rather than concentrated at a single feed location. As a consequence, the proportion of the total material feed which is broken up initially upon entering the breaking zone is increased as compared to that of a hammer mill having a single material feed location. This promotes rapid, uniform reduction of the material and correspondingly rapid movement of reduced material to the discharge openings 128, thereby reducing wear and tear on the equipment and the production of wasteful fines caused by retention of material in the working chamber 24.

A further advantage of the invention is that the hammer mill can be operated in either direction with equal utility owing to the preferred configuration of the upper and lower breakers 104 and 138 and of the hammerheads 70. In particular, the breaker surfaces 106 and 108 of the upper breakers 104 and the side surfaces 142 of the lower breakers 138 are disposed to receive the impact of material flung off the hammerheads 70 in either direction of rotation of the hammerheads, inasmuch as the surfaces 106 and 108 of the upper breakers 104 face in substantially opposite directions as do the side surfaces 142 of each lower breaker 138. Furthermore, the preferred cylindrical configuration of the hammerheads 70 provides impacting surfaces on all sides of the hammerheads so that material is reduced upon impact with the hammerheads in both directions of rotation. Thus, although one side of the hammerheads or of the upper and lower breakers 104 and 138 may be worn down over a period of time by successive impacts, causing a reduction in effectiveness, this is easily remedied simply by reversing the direction of rotation of the hammerheads bringing fresh surfaces into use. It will therefore be appreciated that the capability of operation in either direction prolongs the period during which the hammer mill may be operated at or above a minimum level of effectiveness without the need for shutting down the mill to replace parts worn down by abrasion as a result of the reduction process.

Although a particular embodiment of the invention has been shown and described in the foregoing detailed description, it will be understood that the invention is capable of numerous rearrangements, modifications and substitutions of parts without departing from the scope of the invention as set forth in the claims below.

I claim:

1. A rotary hammer mill for breaking stone and similar material to reduce the material to a desired size comprising a housing, a plurality of hammerheads rotatably supported in said housing for rotation in a substantially horizontal plane to define by their path of movement a substantially horizontally disposed annular breaking zone, means for rotatably driving said hammerheads at a breaking speed sufficient to reduce material impacting against said hammerheads in said breaking zone, material discharge means for discharging reduced material from said housing, material feed means for feeding material into said housing, said feed means being configured to introduce the feed of material down into said annular breaking zone in an annular pattern so that the feed is annularly distributed rather than concentrated at a single feed location, and a plurality of a elongate radially extending upper breakers supported in said housing above said breaking zone, said feed means comprising circumferentially spaced apart feed openings which are configured to distribute material circumferentially down into said breaking zone through said breakers, said upper breakers being configured to break material flung against upper breakers by said hammerheads, whereby the proportion of the total material feed which is broken up initially upon entering said annular breaking zone is increased as compared to that of a hammer mill having a single feed location to promote uniform, rapid reduction of the material in the mill and thereby reduce the production of excessively reduced material caused by retention of material in the mill.

2. The hammer mill of claim 1, wherein said upper breakers each comprises at least one breaking surface disposed at an angle of about 45° to horizontal.

3. The hammer mill of claim 1, wherein said hammerheads are all disposed in substantially the same plane.

4. A rotary hammer mill for breaking stone and similar material to reduce the material to a desired size comprising a housing, a plurality of hammerheads rotatably supported in said housing for rotation in a substantially horizontal plane to define by their path movement a substantially horizontally disposed annular braking zone, means for rotatably driving said hammerheads at a breaking speed sufficient to reduce material impacting against said hammerheads in said breaking zone, material discharge means for discharging reduced material from the housing comprising a plurality of circumferentially spaced apart discharged openings, material feed means for feeding material into said housing, said feed means being configured to introduce the feed of material down into said annular breaking zone in an annular pattern so the feed is annularly distributed rather than concentrated at a single feed location, a plurality of elongate radially extending lower breakers supported in said housing below said annular breaking zone, said lower breakers being circumferentially spaced from adjacent lower breakers by said discharge opening so that reduced material is discharged between said lower breakers, and being configured to break material flung against said lower breakers by said hammerheads, whereby the proportion of the total material feed which is broken up initially upon entering said annular breaking zone is increased as compared to that of a hammer mill having a single feed location to promote uniform, rapid reduction of the material in the mill and thereby reduce the production of excessively reduced material caused by retention of material in the mill.

5. The hammer mill of claim 4, wherein said lower breakers each comprise at least one breaking surface disposed at an angle of about 45° to horizontal.

6. The hammer mill of claim 1 or 4 wherein each of said hammerheads comprises an elongate cylindrical bar.

7. A rotary hammer mill for breaking stone and similar material to reduce the material to a desired size comprising an upright cylindrical housing defining an interior working chamber and having a generally horizontally disposed cover enclosing the top of said housing, a plurality of circumferentially spaced apart feed openings in the cover for introducing material down into the working chamber at a plurality of circumferentially spaced apart feed locations, a substantially vertically disposed shaft rotatably supported in the approximate center of the housing, a rotor fixedly carried on said shaft in said housing, a plurality of generally horizontally disposed and generally radially extending elongate hammerheads having cylindrical ends, said hammerheads being supported on said rotor for rotation therewith together in a substantially horizontal plane to define by said cylindrical ends a substantially horizontally disposed annular breaking zone, said openings being configured to overlie substantially the entire radial width of said breaking zone, means for rotatably driving said shaft at a breaking speed sufficient to cause said hammerheads to break up material impacting thereagainst in said breaking zone, a plurality of elongate, generally radially disposed upper breakers supported in said housing above said breaking zone and spaced therefrom by a distance of about, but greater than, the desired size of the reduced material, said upper breakers being arranged to define an upper breaker ring which overlies substantially the entire breaking zone, and said upper breakers being configured to enable the passage of material down into said breaking zone from said openings in said cover and to break material flung against said upper breakers by said hammerheads, a plurality of elongate, generally radially disposed lower breakers supported in said housing below said breaking zone and spaced therefrom by a distance of about, but greater than, the desired size of the reduced material, said lower breakers being arranged to define a lower breaker ring which underlies substantially the entire breaking zone, and said lower breakers being configured to break material flung against said lower breakers by said hammerheads, and being circumferentially spaced apart a distance of about, but greater than, the desired size of the reduced material to define discharge openings between adjacent lower breakers through which reduced material is discharged from the housing.

8. The hammer mill of claim 7, wherein each of said plurality of upper and lower breakers comprises a ring of generally planar circumferentially spaced apart surfaces disposed at an angle of about 45° with respect to horizontal and facing in a direction generally opposite to the direction of movement of said cylindrical ends of said hammerheads in said breaking zone.

9. A rotary hammer mill for breaking stone and similar material to reduce the material to a desired size, comprising a housing defining an interior working chamber in which material is reduced, feed means for feeding material into the working chamber of said housing, discharge means for discharging reduced material from said housing, a plurality of generally radially disposed elongate hammerheads rotatably supported in said housing for rotation together about a substantially vertical axis to define a substantially horizontally disposed annular breaking zone in said working chamber substantially concentrically disposed with respect to said vertical axis, means for rotatably driving said hammerheads in both a clockwise and a counterclockwise direction of rotation and at a breaking speed sufficient to cause said hammerheads to reduce material impacting thereagainst in said breaking zone, a plurality of upper breakers supported in said housing above said breaking zone, a plurality of lower breakers supported in said housing below said breaking zone, said upper and lower breakers being configured to break material flung against said first and second breakers by said rotating hammerheads in both the clockwise and counterclockwise directions of rotation of said hammerheads, and said hammerheads having breaking surfaces defined thereon on both directional sides thereof so that said hammerheads will reduce material upon impact therewith in both the clockwise and counterclockwise directions of rotation.

10. The hammer mill of claim 9, wherein said feed means comprises a plurality of circumferentially spaced apart feed openings in said housing which are configured to introduce the material down into said breaking zone in an annular pattern so that the feed of material into the breaking zone is annularly distributed rather than concentrated at a single feed location.

11. The hammer mill of claim 9, wherein said upper and lower breakers comprise alternating angular surfaces which are disposed approximately perpendicular to adjacent angular surfaces and at an angle of about 45° with respect to horizontal so that angular surfaces are provided facing in a direction generally opposite to the direction of rotation of the hammerheads in both of said clockwise and counterclockwise directions of rotation.

12. A rotary hammer mill for breaking stone and similar material to reduce the material to a desired size comprising an upright cylindrical housing defining an interior working chamber and having a cover enclosing the top of said housing, a plurality of circumferentially spaced apart feed openings in the cover for introducing material down into the working chamber at a plurality of circumferentially spaced apart feed locations, a substantially vertically disposed shaft rotatably supported in the approximate center of the housing, a rotor fixedly carried on said shaft in said housing, a plurality of generally horizontally disposed and generally radially extending elongate hammerheads having material-impacting ends, said hammerheads being supported on said rotor for rotation therewith together in a substantially horizontal plane to define by said material impacting ends a substantially horizontally disposed annular breaking zone, said openings being configured to overlie substantially the entire radial width of said breaking zone, means for rotatably driving said shaft at a breaking speed sufficient to cause said material impacting ends of said hammerheads to break up material impacting thereagainst in said breaking zone, a plurality of generally radially disposed upper breakers supported in said housing above said breaking zone and spaced therefrom by a distance of about, but greater than, the desired size of the reduced material, said upper breakers being arranged to define an upper breaker ring which overlies substantially the entire breaking zone, and said upper breakers being configured to enable the passage of material down into said breaking zone therethrough from said openings in said cover and to break material flung against said upper breakers by said hammerheads, a plurality of generally radially disposed lower breakers supported in said housing below said breaking zone and spaced therefrom by a distance of about, but greater than, the desired size of the reduced material, said lower breakers being arranged to define a lower breaker ring which underlies substantially the entire breaking zone, and said lower breakers being configured to break material flung against said lower breakers by said hammerheads, and being circumferentially spaced apart a distance of about, but greater than, the desired size of the reduced material to define discharge openings between adjacent lower breakers through which reduced material is discharged from the housing.

13. The hammer mill of claim 12, wherein each of said outer ends of said hammerheads comprises an elongate, cylindrical bar.

14. The hammer mill of claim 12, wherein each of said plurality of upper and lower breakers comprises a ring of generally planar circumferentially spaced apart surfaces disposed at an angle of about 45° with respect to horizontal and facing in a direction generally opposite to the direction of movement of said material impacting ends of said hammerheads in said breaking zone.

* * * * *